United States Patent [19]

Nishimoto et al.

[11] Patent Number: 4,757,338

[45] Date of Patent: Jul. 12, 1988

[54] DISC FILM DEVELOPING TREATMENT APPARATUS

[75] Inventors: Kanichi Nishimoto; Nobuaki Mihara; Hiroaki Ikehara, all of Wakayama, Japan

[73] Assignee: Noritsu Kenkyu Center Co., Ltd., Wakayama, Japan

[21] Appl. No.: 62,577

[22] Filed: Jun. 16, 1987

[30] Foreign Application Priority Data

Jun. 24, 1986 [JP] Japan ..... 61-95370[U]

[51] Int. Cl.[4] ..... G03D 3/06

[52] U.S. Cl. ..... 354/299; 354/323; 354/324; 354/330

[58] Field of Search ..... 354/320, 321, 322, 323, 354/324, 329, 330, 325, 299

[56] References Cited

U.S. PATENT DOCUMENTS

| | | | |
|---|---|---|---|
| 3,890,629 | 6/1975 | Huss | 354/299 |
| 4,161,356 | 7/1979 | Giffin | 354/325 |
| 4,350,429 | 9/1982 | Slavin | 354/323 |
| 4,456,355 | 6/1984 | Kaufmann et al. | 354/330 |
| 4,502,772 | 3/1985 | Mihara | 354/330 |
| 4,655,575 | 4/1987 | Murakami | 354/322 |
| 4,712,899 | 12/1987 | Nishimoto | 354/330 |

*Primary Examiner*—A. A. Mathews

*Attorney, Agent, or Firm*—Larson & Taylor

[57] ABSTRACT

The one end of each of liquid introduction pipes through which treating ilquid is introduced from the treating liquid storing baths into the interior of a single disc film treating tank is opened on the peripheral wall of the disc film treating tank. A partition wall is provided in front of a series of treating liquid supply ports on the peripheral wall of the disc film treating tank to constitute a waste liquid chamber which is effective for inhibiting an occurrence of mixing of one treating liquid with other one. The height and width of the partition wall is so determined that stream of the treating liquid flies above the top of the partition wall under the effect of flow inertia.

6 Claims, 4 Drawing Sheets

DISC FILM DEVELOPING TREATMENT APPARATUS

BACKGROUND OF THE INVENTION

1. Field of the Invention

The present invention relates to a photosensitive material treating apparatus, particularly an apparatus for developing disc films as photosensitive material. More particularly, the present invention relates to a disc film developing treatment apparatus which assures that disc films of which consumption is maintained at a lower level at present can be treated by utilizing a part of treating liquid in a so-called automatic developing apparatus for treating a strip of photosensitive material such as photographic film, printing paper or the like each of which is used widely.

2. Description of the Prior Art

Several years ago, a disc-shaped photographic film that is called disc film in which photographic exposure portions are arranged in an equally spaced relation along the periphery of the disc has been developed as photosensitive material for camera in place of a strip of photographic film which is used widely.

As a result of development of disc film, there were already several proposals as to treating apparatus, treating machines and associated devices usable for carrying out a series of so-called developing treatments for disc film ranging from developing to stabilizing. However, each of the above-mentioned conventional apparatuses, machines and devices is constructed in compliance with the conventional treating process or system for treating a large number of photographic films at a highly increased operational efficiency. Accordingly, employment of the conventional treating process or system is not economically advantageous and is impracticle due to the current situation that an amount of consumption of disc films is still at a lower level.

In view of the fact as mentioned above, inventors who work with the same assignee as the inventors of the present invention developed an apparatus for treating disc films as disclosed in U.S. Pat. No. 4,502,772, British Pat. No. 2122771B and West German Pat. No. 3317814 or U.S. Pat. No. 4,655,575, British Pat. No. 2173018A and West German Patent Application No. P 3610026.9-51. However, each of the above-noted prior inventions concerning apparatus, machines and devices is constructed in compliance with the established technical concept for treating a large number of photographic films at a highly increased operational efficiency. Accordingly, employment of the conventional treating apparatus, machines and associated devices is not satisfactory in respect of structure and construction, is not economically advantageous and is impracticle due to the current situation that an amount of consumption of disc film is still at a lower level.

Thus, the applicant of the present invention has made further development and invented an invention as disclosed in U.S. patent application Ser. No. 07/010421, now U.S. Pat. No. 4,712,899, British Patent Application No. 8702954 and West German Patent Application No. P 3703578.9-51 as well as U.S. patent application Ser. No. 07/010422, British Patent Application No. 8702955 and West German Patent Application No. P 3703852.4-51, all owned by the same assignee.

SUMMARY OF THE INVENTION

Thus, the present invention has been made with the foregoing background in mind.

A main object of the present invention is to provide a disc film developing treatment apparatus which assures that developing treatment apparatus of disc films is achieved with the use of a single treatment tank, although demand for disc films tends to slightly increase year by year but consumption is kept still at a lower level on the whole.

Another object of the present invention is to provide a disc film developing treatment apparatus which assures that undesirable mixing of one treating liquid delivered from a treating liquid bath with another liquid is minimized, reduction in treating capability of treating liquid is inhibited and thereby the best developing treatment effect is obtainable with small consumption of treating liquid.

Another object of the present invention is to provide a disc film developing treatment apparatus which is designed in small dimensions and simple in structure corresponding to small consumption and size of disc films and which assures that the apparatus is handled easily.

Further, another object of the present invention is to provide a disc film developing treatment apparatus which assures that the apparatus is attached to a conventional long developing apparatus so that a part of structure of the last-mentioned apparatus is in common use for both the apparatuses and which makes it possible to utilize treating liquids in treating liquid baths in the last-mentioned apparatus whereby an area required for installing the apparatus can be reduced and highly economical performance is obtainable.

To accomplish the above objects there is proposed according to the present invention a disc film developing treatment apparatus which comprises a plurality of treatment liquid baths for storing a plurality of treatment liquids required for developing disc films, a single disc film treatment tank to which the treatment liquids are successively supplied from the treatment liquid baths in accordance with a predetermined order and from which the treatment liquids are discharged after completion of intended treatment, the disc film treatment tank being connected to the treatment liquid baths via a plurality of liquid introduction pipes of which foremost end is opened on the peripheral wall of a tank casing to form a liquid supply port, and a waste liquid chamber provided between a partition wall and the peripheral wall of the tank casing of the disc film treating tank for draining treatment liquids in the liquid introduction pipes by dripping without any occurrence of mixing of treatment liquid in the disc film treatment tank with residual treatment liquids in other liquid introduction pipes with the aid of a partition wall. The height and width of the partition wall is so determined that a certain treatment liquid is properly supplied into the interior of the disc film treatment tank while flowing above the top of the partition wall under the effect of flow inertia.

Other objects, features and advantages of the present invention will become readily apparent from reading of the following description which has been made with reference to the accompanying drawings which illustrates a preferred embodiment of the invention.

BRIEF DESCRIPTION OF THE DRAWINGS

The accompanying drawings will be briefly described below. They schematically illustrate a disc film developing treatment apparatus in accordance with an embodiment of the present invention which is attached to a conventional automatic developing treatment machine such as film processor or the like manufactured and sold under a tradename of QSS by Noritsu Koki Co., Ltd. wherein the disc film developing treatment apparatus is intended to develope a small number of disc films and the conventional automatic developing treating machine is intended to develope a large number of photosensitive materials such as photographic film, printing paper or the like. It should be noted that the drawings are prepared to such an extent that they can be easily understood by any expert in the art to which the present invention pertains, although components which could be easily understood by him are not illustrated as far as possible for the purpose of simplification of illustration.

DESCRIPTION OF THE PREFERRED EMBODIMENT

Now, the present invention will be described in a greater detail with reference to the accompanying drawings which schematically illustrate a disc film developing treatment apparatus in accordance with a preferred embodiment thereof.

Figure 1:
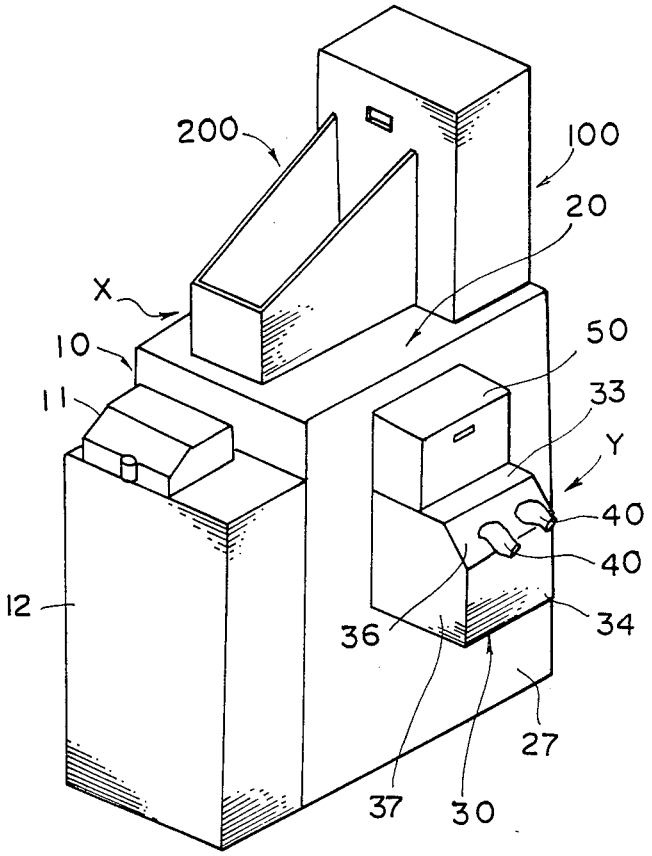
FIG. 1 is a fragmentary perspective view of the disc film developing treatment apparatus as seen from the above in the downwardly inclined direction.

First, refering to FIG. 1, a section as identified by reference symbol X is a treatment apparatus usable for treating a strip of photographic film wherein the apparatus comprises an automatic developing treatment section 10 similar to a conventional automatic developing machine for treating a strip of photographic film manufactured and sold under a tradename of QSS by Noritsu Koki Co., Ltd., a drier 100 for drying a strip of photographic film which has been developed in the foregoing developing treatment section 10, and a stacker 200 in which a number of photographic films delivered from the drier 100 are stored one after another. A section identified by reference symbol Y is a disc film developing treatment unit which is an apparatus according to one embodiment of the invention.

In the automatic developing treatment section 10 reference numeral 20 designates an outer casing including an outer panel as a main component of which the fore end part includes an insert box 11, a control box 12 or the like. Both the outer casing 20 and the insert box 11 are communicated with one another via a photographic film inlet port which is not shown in the drawings. On the rear end of the outer casing 20 a photographic film outlet (which is not shown in the drawings) is disposed to be communicated with the drier 100.

Figure 2:
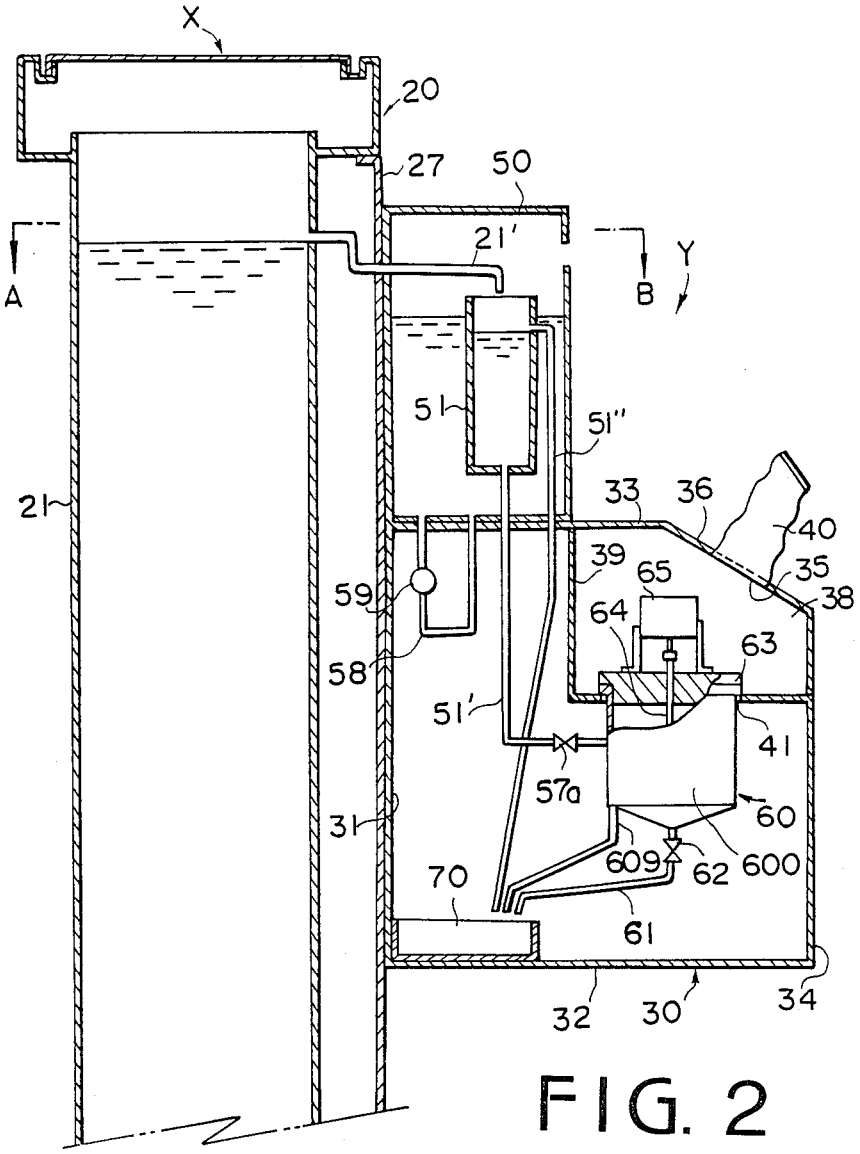
FIG. 2 is a schematic vertical sectional view of an apparatus according to the present invention.
Figure 3:
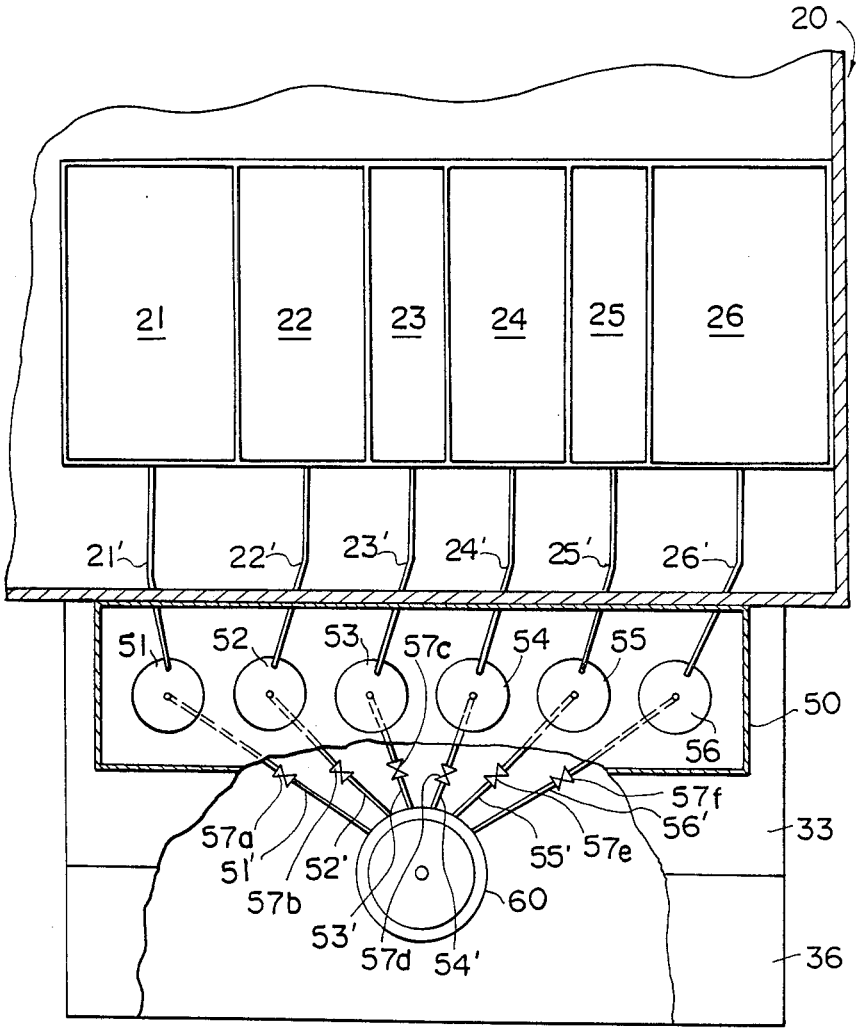
FIG. 3 is a sectional plan view taken in the direction of the arrows along the line A-B in FIG. 2 illustrating an apparatus according to the present invention.

As shown in FIGS. 2 and 3, the outer casing 20 encloses a developing liquid bath 21, a bleaching liquid bath 22, a washing water bath 23, a fixing liquid bath 24, a washing water bath 25 and a stabilizing liquid bath 26 which are arranged one after another. Each of baths 21 through 26 is equipped with a treating liquid adding device and a heating device for maintaining the treating liquid at the optimum temperature by heating.

With reference to the disc film developing unit, as identified by reference symbol Y, reference numeral 30 designates a dark box attached to the side panel 27 of the outer casing 20. As shown in FIGS. 2 and 3, the dark box 30 includes: an inside wall panel 31 attached to the side panel 27; a bottom panel 32; a top panel 33 having a width narrower than that of the bottom panel 32; an outer panel 34 having a height lower than the inside panel 31; an inclined panel 36 by way of which the outer panel 34 is connected to the top panel 33 and which has two light sealing sleeves 40 which can be closed to assure lighttightness; a trapezoidal fore end panel 37 and a trapezoidal rear end panel 38. Reference numeral 39 designates a L-shaped partition plate of which the horizontal portion is formed with a disc film treatment tank fitting hole 41 to be described later. The vertical plate portion of the partition plate 39 is spaced away from the inside panel 31. The fore and rear ends of the vertical plate portion of the partion plate 39 are connected to the fore and rear end panels 37 and 38 respectively and the end of the horizontal plate portion is connected to the upper part of the outer panel 34, as best shown in FIG. 2.

Further, in FIGS. 2 and 3, reference numeral 50 designates a hot water bath which is disposed on the top panel 33 of the dark box 30. The hot water bath 50 is provided with a stiring piping 58 having a recirculating pump 59 disposed midway thereof, a thermostat, heater, a control circuit and others each of which are not shown in the drawings and, moreover, it includes a constant temperature maintaining device for maintaining each of treating liquids at a properly determined temperature such as a specified temperature or the like. Further, the hot water bath 50 is provided with overflowed treating liquid storing tanks 51, 52, 53, 54, 55 and 56 into which respective liquids overflowed from the developing liquid bath 21, the bleaching liquid bath 22, the washing water bath 23, the fixing liquid bath 24, the washing water bath 25 and the stabilizing liquid bath 26 in the automatic developing unit X for developing a strip of photographic film are separately introduced via respective overflow pipes 21', 22', 23', 24', 25', and 26'. The overflowed treating liquid storing tanks 51, 52, 53, 54, 55 and 56 are communicated with a disc film treating tank 60 via liquid introduction pipes 51', 52', 53', 54', 55', and 56' extending between the bottom of the aforesaid storing tanks and the disc film treating tank 60 with respective solenoid valves 57*a*, 57*b*, 57*c*, 57*d*, 57*e* and 57*f* interposed therebetween so that a plurality of disc films DF can be subjected to developing, bleaching, water washing, fixing, water washing and stabilizing separately. Further, overflow pipes 51", 52", 53", 54", 55" and 56" extend from the respective upper parts of the storing tanks 51, 52, 53, 54, 55 and 56 to a waste liquid tank 70 to be described later (overflow pipes 52" to 56" are not shown in the drawings for the purpose of simplification of illustration).

Now, a disc film treating tank, as identified by reference numeral 60, is a component in the apparatus of the invention and its structure will be described below with reference to FIGS. 2 and 4 to 6. The disc film treating tank 60 includes a tank casing 600 which is fixedly fitted into a disc film treating tank fitting hole 41 on the horizontal plate of the L-shaped partition plate 39. The tank casing 600 is equipped with a solenoid valve 62 at the bottom thereof which is operated in such a manner as described later. Further, it has a drain pipe 61 through which treating liquids are drained to a waste liquid tank 70 after completion of intended treatment. The tank casing 600 has a tank cap 63 detachably fitted thereinto through the upper opening. The tank cap 63 rotatably supports a disc film support spindle 64 of which the lower end part removably supports one or plural disc films DF and a motor 65 is fixedly mounted on brackets for rotating the disc film support spindle 64.

Figure 4:
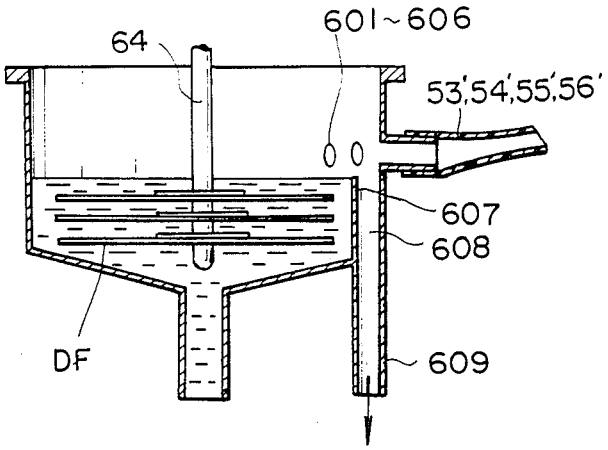
FIG. 4 is a vertical sectional view of a disc film treating tank according to the present invention.
Figure 5:
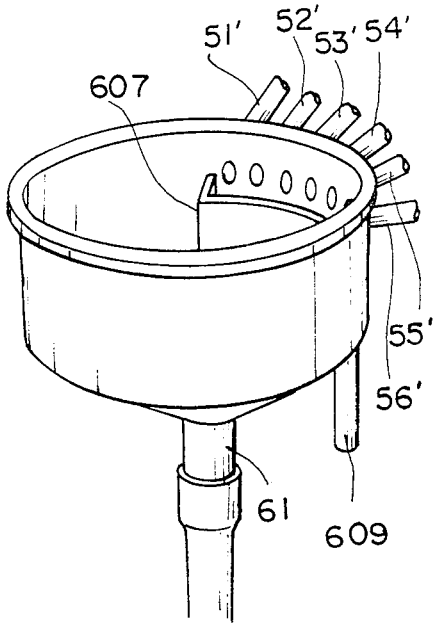
FIG. 5 is a perspective view of the disc film treating tank in FIG. 4.

As shown in FIGS. 4 and 5, the tank casing 600 is formed with a plurality of liquid supply ports 601, 602, 603, 604, 605 and 606 on the peripheral wall thereof at the position located a little bit above a surface level of treating liquid required for treating disc films DF and treating liquid is introduced into the disc film tank 60 through the liquid supply ports 601 to 606 of a plurality of liquid introduction pipes 51', 52', 53', 54', 55' and 56'.

The apparatus includes a control circuit (not shown) for controlling opening and closing of the solenoid valve 62 on the liquid drain pipe 61 as well as the solenoid valves **57*a*, 57*b*, 57*c*, 57*d*, 57*e* and 57*f*. Thus, by controlling these solenoid valves, treating liquid required for the first treatment is introduced into the interior of the disc film treating tank 60 and, on completion of the first treatment the treating liquid, is discharged into the waste liquid tank 70. Then, treatment liquid required for the next treatment is introduced into the interior of the treating liquid tank 60** and, on completion of the treatment, the treatment liquid is discharged in the same manner as in the case of the first treatment. Other treatments are successively carried out in the same manner in accordance with a predetermined order. Timers and other instruments are incorporated in the control circuit so that the opening and closing time for solenoid valves and disc film treating time are set as required for each of the following operations.

As shown in FIGS. 4 and 5, the tank casing 600 is provided with a partition wall 607 in front of liquid supply ports 601 to 606 in order to define a waste liquid chamber 608 formed between the partition wall 607 and the peripheral wall of the tank casing 600. Height and width of the partition wall 607 are so selected that streams of treating liquids passing through the liquid supply ports 601 to 606 via the liquid introduction pipes 51' to 56' flow over the partition wall 607 under the effect of flow inertia. The lower part of the waste liquid chamber 608 merges in a waste liquid drain pipe 609 in order to assure that residual treatment liquid which drips in the waste liquid chamber 608 from the liquid introduction pipes 51' to 56' is drained to the waste liquid tank 70 via the waste liquid drain pipe 609.

Since the developing treatment apparatus of the present invention is constructed in the above-described manner, a strip of photographic film is successively developed in an automatic manner with the use of the developing bath 21, the bleaching liquid bath 22, the washing water bath 23, the fixing liquid bath 24, the washing water bath 25 and the stabilizing bath 26 in the developing treatment unit X. Treating liquids are additionally supplied into each of the above-mentioned baths with overflowed treating liquids being introduced into the overflowed liquid storing tanks 51, 52, 53, 54, 55 and 56 from the treating liquid baths 21, 22, 23, 24, 25 and 26 via overflow pipes 21', 22', 23', 24', 25' and 26' to be stored therein. The thus stored liquids are maintained at a predetermined temperature such as specified temperature or the like with the aid of hot water in the hot water bath, and overflowed liquids from the overflow liquid storing tanks 51, 52, 53, 54, 55 and 56 are drained to the waste liquid tank 70 via overflow pipes 51'', 52'', 53'', 54'', 55'' and 56''.

When disc films DF are developed, a tank cap 63 having several disc film DF held at the lower end part of the disc film supporting spindle 64 in the dark box 30 is firmly fitted into the tank casing 600. Thereafter, a solenoid valve 62 on the drain pipe 61 is closed and a solenoid valve **57*a* on the liquid introduction pipe 51' is opened with the aid of the control circuit (not shown) having timers and others incorporated therein whereby a properly determined volume of treating liquid required for the purpose of developing is introduced into the interior of the tank casing 600 through the liquid supply port 601 from the overflowed liquid storing tank 51 via the liquid introduction pipe 51'. Then, the motor 65 is driven for a required period of time to rotate or reciprocate the spindle 64** in one or both directions. Thus, the first step of developing is achieved.

After completion of the first step of treatment, the solenoid valve 62 is opened to drain used developing liquid to the waste liquid tank 70 and, thereafter, it is closed for initiating the next step of treatment. The solenoid valve **57*b* on the liquid introduction pipe 52' is opened and a properly determined volume of treating liquid required for bleaching is introduced into the interior of the tank casing 600 through the second liquid supply port 602 from the overflowed liquid storing tank 52 so that the next step of bleaching is achieved. By repeatedly carrying out the above-mentioned operations, fixing and stabilizing are achieved with the step of water washing properly interposed between the adjacent steps. It should be noted that a little amount of treating liquid resides in the inner area of the liquid introduction pipes 51' to 56' between the solenoid valves 57*a* to 57*f* and the liquid supply ports 601 to 606 even after the solenoid valves 57*a* to 57*f* are closed and then the residual liquid existent therein in that way drips in the tank casing 600**.

Due to the fact that any conventional apparatus does not take any measure against the above-mentioned problem, residual liquid is caused to mix with other treating liquid during treating operation, resulting in accuracy of treating being affected adversely. However, the apparatus of the invention inhibits an occurrence of the problem as mentioned above by employing the following measures in respect of construction.

Specifically, during normal liquid supply a stream of treating liquid has a considerably high flow speed corresponding to positional energy which is obtained by height difference between the overflowed liquid storing tanks 51 to 56 and the liquid supply ports 601 to 606. Accordingly, each of the treating liquids flows into the interior of the tank casing 600 while flowing above the waste liquid chamber 608. On the other hand, a small volume of residual liquid drips in the waste liquid chamber 608 and is then discharged from the tank casing 600 because the residual treating liquid has no flowing speed. This leads to a result that the undesirable phenomenon of mixing of one treating liquid with other one does not take place in the tank casing 600.

Figure 6:
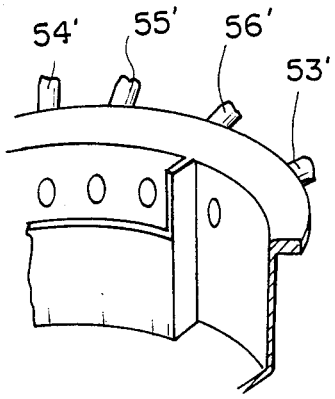
FIG. 6 is a fragmentary perspective view of the disc film treating tank which is slightly modified from that in FIGS. 4 and 5.

While the present invention has been described above with respect to a preferred embodiment thereof, it should of course be understood that it should not be limited only to this but various changes or modifications may be made in a suitable manner without any departure from the scope of the invention. For instance, means for generating speed of flow of treating liquid is not limited to positional energy. In place of the latter forcible flow speed generating means (such as axial pump or the like) may be employed. Further, there is no necessity that a waste liquid chamber is provided for all liquid supply ports. For instance, arrangement may be made for the waste liquid chamber in such a manner as illustrated in FIG. 6. The present invention has been described with respect to the illustrated case where a disc film treating unit is attached to a long film treating unit but it should not be limited only to this. Alternatively, the present invention may be applied to the case where only disc films are treated.

As will be apparent from the above description, the disc film developing treatment apparatus of the present invention does not require arranging a plurality of developing treatment baths in alignment with one another in a long and large dark box but requires a single disc film tank which inhibits an occurrence of malfunction inherent in employment of a single tank such as undesirable mixing of one treating liquid with other one. Thus, it becomes possible to provide a disc film developing treatment apparatus which is suitable for economically developing disc films of which consumption is maintained still at a lower level at present.

Moreover, since the disc film developing treatment apparatus of the invention can be attached to a treatment apparatus for treating a strip of photographic film, printing paper or the like, a part of the first-mentioned apparatus is constituted by the last-mentioned apparatus whereby an area required for installing the whole apparatus can be reduced. Further, since treating liquids held in treating liquid baths of the last-mentioned apparatus can be utilized, it becomes possible to provide a disc film developing treatment apparatus which is highly economical.

What is claimed is:

1. A disc film developing treatment apparatus comprising:

a plurality of treatment liquid storing baths for storing a respective plurality of treatment liquids required for developing disc films;

a disc film treatment tank defined by a wall to which said treatment liquids are successively supplied from said treatment liquid baths in accordance with a predetermined order and from which the treatment liquids are discharged after completion of intended treatment, said disc film treatment tank being connected to the treatment liquid baths via a plurality of respective liquid introduction pipes each of which is connected to the peripheral wall of said tank to form a liquid supply port, and a waste liquid chamber defined by a partition wall and the inner peripheral wall of said tank of the disc film treatment tank for draining treatment liquids in said liquid introduction pipes by dripping out of said ports without any occurrence of mixing of the treatment liquid in the disc film treatment tank with residual liquids in other introduction pipes with the aid of said partition wall, the height and width of said partition wall being constructed and arranged relative to said ports that treatment liquid is supplied into the interior of the disc film treatment tank while flowing as a stream above the top of said partition wall under the effect of liquid flow inertia.

2. A photographic apparatus comprising the disc film developing treatment apparatus recited in claim 1, said disc film developing treatment apparatus being attached to an automatic photosensitive material developing apparatus in side-by-side relation in such a manner that a plurality of treating liquids in said automatic photosensitive material developing apparatus can be introduced into a respective plurality of developing treatment liquid baths in the disc film developing treatment apparatus, said automatic photosensitive material developing apparatus comprising a series of treating liquid baths in a dark box for carrying out a series of developing treatments such as developing, bleaching, fixing or the like for a strip of photosensitive material, each of said treating liquid baths of said disc film developing treatment apparatus being equipped with means for additionally supplying a treating liquid and a constant temperature means for heating a treating liquid to a temperature suitable for use in developing treatment.

3. The invention as claimed in claim 1 or 2, wherein treating liquids employed for treating disc films are respective treating liquids overflowed from the treating liquid baths in an automatic photosensitive material developing apparatus for developing a strip of photosensitive material.

4. The invention as claimed in claim 1 or 2, wherein delivery of each of the treating liquids from the treating liquid storing baths to the disc film treating tank is effected under the effect of height difference between the treating liquid storing tanks and the disc film treatment tank.

5. The invention as claimed in claim 4, wherein each of the liquid introduction pipes through with treating liquid is introduced from the treating liquid storing tanks to the disc film treating tank is equipped with a solenoid-operated valve.

6. The invention as claimed in claim 1 or 2, wherein each of the liquid introduction pipes through which treating liquid is introduced from the treating liquid storing tanks to the disc film treating tank is equipped with an axial pump.

* * * * *